US012723789B2

(12) United States Patent
Wang et al.

(10) Patent No.: US 12,723,789 B2
(45) Date of Patent: Sep. 1, 2026

(54) COMPRESSOR AND REFRIGERATION APPARATUS

(71) Applicant: GUANGDONG MEIZHI PRECISION-MANUFACTURING CO., LTD., Foshan (CN)

(72) Inventors: Xiaofeng Wang, Foshan (CN); Yong Guo, Foshan (CN); Shengming Liang, Foshan (CN); Hongwei Zeng, Foshan (CN)

(73) Assignee: GUANGDONG MEIZHI PRECISION-MANUFACTURING CO., LTD., Foshan (CN)

( * ) Notice: Subject to any disclaimer, the term of this patent is extended or adjusted under 35 U.S.C. 154(b) by 0 days.

(21) Appl. No.: 18/209,807

(22) Filed: Jun. 14, 2023

(65) Prior Publication Data

US 2023/0324094 A1 Oct. 12, 2023

Related U.S. Application Data

(63) Continuation of application No. PCT/CN2021/122294, filed on Sep. 30, 2021.

(30) Foreign Application Priority Data

Mar. 30, 2021 (CN) ..... 202120649333.2

(51) Int. Cl.
*F25B 41/40* (2021.01)
*F04C 29/12* (2006.01)
*F25B 31/02* (2006.01)

(52) U.S. Cl.
CPC ..... *F25B 41/40* (2021.01); *F04C 29/12* (2013.01); *F25B 31/023* (2013.01); (Continued)

(58) Field of Classification Search
CPC ..... F25B 41/40; F25B 31/023; F25B 31/026; F25B 1/04; F25B 31/00; F04C 29/12; (Continued)

(56) References Cited

U.S. PATENT DOCUMENTS 5,171,042 A * 12/1992 Faidiga ..... F16L 13/0263 285/55
5,217,359 A * 6/1993 Kawahara ..... F04C 29/0007 418/55.6
(Continued)

FOREIGN PATENT DOCUMENTS

BR PI0603392 A * 4/2008 ..... F16L 41/082
CH 644198 A5 * 7/1984 ..... F17D 1/04
(Continued)

OTHER PUBLICATIONS

CN-102962633-A Translation (Year: 2024).*
(Continued)

*Primary Examiner* — J. T. Newton
(74) *Attorney, Agent, or Firm* — K&L Gates LLP

(57) ABSTRACT

A compressor and a refrigeration apparatus are provided. The compressor has a compressor body, a reservoir and a connection pipe. The compressor body has a housing and a compression assembly disposed in the housing. A compression cavity is defined by the compression assembly and has an air suction port. A guide pipe is disposed at the housing. The reservoir has a suction pipe. The connection pipe is disposed in the guide pipe. A first end of the connection pipe is connected to the air suction port. The suction pipe is disposed in the connection pipe and connected to a second end of the connection pipe. The connection pipe can be a copper pipe. Each of the suction pipe and the guide pipe can be a steel pipe.

20 Claims, 5 Drawing Sheets

(52) U.S. Cl.
CPC ..... *F25B 31/026* (2013.01); *F04C 2240/30* (2013.01); *F04C 2240/806* (2013.01)

(58) Field of Classification Search
CPC ..... F04C 2240/30; F04C 2240/806; F04C 18/356; F04C 2230/231; F04C 2240/804; F04C 23/008
See application file for complete search history.

(56) References Cited

U.S. PATENT DOCUMENTS

| | | | | | |
|---|---|---|---|---|---|
| 5,338,072 | A * | 8/1994 | Bitter | F16L 13/08 | 228/198 |
| 6,186,556 | B1 * | 2/2001 | Masuyama | F04C 23/008 | 285/332.1 |
| 8,348,647 | B2 * | 1/2013 | Kiyokawa | F04C 23/008 | 418/152 |
| 10,626,867 | B2 * | 4/2020 | Ozu | F04C 29/0021 | |
| 2019/0319501 | A1 * | 10/2019 | Xiang | H02K 1/16 | |
| 2023/0324094 | A1 * | 10/2023 | Wang | F25B 31/026 | 418/181 |

FOREIGN PATENT DOCUMENTS

| | | | | |
|---|---|---|---|---|
| CN | 102472275 A | * | 5/2012 | F01C 21/02 |
| CN | 102962633 A | * | 3/2013 | |
| CN | 103506771 A | * | 1/2014 | B23K 1/00 |
| CN | 106812700 A | * | 6/2017 | F04C 29/00 |
| CN | 207229340 U | * | 4/2018 | |
| CN | 208268075 U | | 12/2018 | |
| CN | 209230096 U | | 8/2019 | |
| CN | 212250469 U | | 12/2020 | |
| JP | 2010038086 A | | 2/2010 | |

OTHER PUBLICATIONS

CN-207229340-U Translation (Year: 2024).*
Translation of CN-102472275-A (Year: 2024).*
Translation PI0603392-A (Year: 2025).*
Translation CH-644198-A5 (Year: 2025).*
Translation CN-103506771-A (Year: 2025).*
Translation CN-106812700-A (Year: 2025).*
Translation CN-103506771-A (Year: 2026).*
International Search Report dated Nov. 26, 2021 issued in PCT/CN2021/122294.
Written Opinion dated Nov. 26, 2021 received in International Application No. PCT/CN2021/122294.
Supplementary European Search Report dated Feb. 6, 2024 received in European Patent Application No. EP 21934463.7.

* cited by examiner

COMPRESSOR AND REFRIGERATION APPARATUS

CROSS-REFERENCE TO RELATED APPLICATIONS

The present application a continuation of International Application No. PCT/CN2021/122294, filed on Sep. 30, 2021, which claims priority to and benefits of Chinese Patent Application No. 202120649333.2, filed on Mar. 30, 2021, the entire contents of each of which are incorporated herein by reference for all purposes. No new matter has been introduced.

FIELD

The present disclosure relates to the field of refrigeration technologies, and more particularly, to a compressor and a refrigeration apparatus.

BACKGROUND

A connection pipe assembly of a compressor includes a guide pipe connected to a compressor body, a suction pipe disposed on a reservoir, and a connection pipe. The connection pipe is disposed in the guide pipe and extends into the compressor body to be brought into communication with a compression cavity. The suction pipe of the reservoir is disposed in the connection pipe. Welding is applied to a fixed connection between the guide pipe and the connection pipe, and likewise to a fixed connection between the connection pipe and the suction pipe of the reservoir. In the related art, the connection pipe, the guide pipe, and the suction pipe are generally copper pipes due to thermal conductivity of the copper pipe. However, in addition to high cost of the copper pipe, uniform distribution of solder in a welding gap is necessarily a guarantee of a welding quality when the copper pipe is welded. As a result, the welding is inefficient.

The above-mentioned content is merely intended to assist in understanding the technical solutions of the present disclosure, and does not represent an admission that the above-mentioned content is the related art.

SUMMARY

In one embodiment of the present disclosure, a compressor aiming to at least solve technical problems of lower welding efficiency and high cost of a connection pipe assembly in an existing compressor is provided.

To achieve the above embodiment, the present disclosure provides a compressor. The compressor includes: a compressor body, a reservoir and a connection pipe. the compressor body includes a housing and a compression assembly disposed in the housing. A compression cavity being defined by the compression assembly and having an air suction port, and a guide pipe being disposed at the housing. The reservoir includes a suction pipe and a connection pipe disposed in the guide pipe. A first end of the connection pipe is connected to the air suction port. The suction pipe is disposed in the connection pipe and connected to a second end of the connection pipe. The connection pipe is a copper pipe; and each of the suction pipe and the guide pipe is a steel pipe.

In one embodiment, an inner surface of the connection pipe is spaced apart from an outer surface of the suction pipe to form a first welding gap; and an outer surface of the connection pipe is spaced apart from an inner surface of the guide pipe to form a second welding gap. A width of the first welding gap is smaller than a width of the second welding gap.

In one embodiment, the width of the first welding gap is smaller than or equal to 0.3 mm; and/or the width of the second welding gap is greater than or equal to 0.3 mm.

In one embodiment, the width of the first welding gap is greater than or equal to 0.05 mm.

In one embodiment, the width of the second welding gap is smaller than or equal to 0.8 mm.

In one embodiment, the connection pipe is fixedly connected to the suction pipe through high-frequency induction brazing; and the connection pipe is fixedly connected to the guide pipe through high-frequency induction brazing.

In one embodiment, the connection pipe includes a position limit section and a flare section. The flare section extends from the position limit section and in a direction facing away from the compressor body. The first welding gap includes a first sub-gap and a second sub-gap. The first sub-gap is formed between an inner surface of the position limit section and the outer surface of the suction pipe. The second sub-gap is formed between an inner surface of the flare section and the outer surface of the suction pipe. A width of the first sub-gap is smaller than or equal to a width of the second sub-gap.

In one embodiment, the flare section has an inner diameter greater than an inner diameter of the position limit section; and a stepped surface is formed between the inner surface of the flare section and the inner surface of the position limit section.

In one embodiment, the flare section has a cross section gradually flaring in a direction facing away from the position limit section.

In one embodiment, the connection pipe further includes a neck section connected to an end of the position limit section facing away from the flare section. The neck section has an inner diameter smaller than an inner diameter of the position limit section and greater than an inner diameter of the suction pipe, and a stop surface is formed between an inner surface of the neck section and the inner surface of the position limit section.

In one embodiment, the connection pipe further includes a connection section. An end of the connection section is connected to an end of the neck section facing away from the position limit section, and another end of the connection section is of a conical shape and in interference fit with the air suction port.

The present disclosure further provides a refrigeration apparatus. The refrigeration apparatus includes a compressor body including a housing and a compression assembly disposed in the housing. A compression cavity being defined by the compression assembly and having an air suction port, and a guide pipe being disposed at the housing; a reservoir including a suction pipe. A connection pipe disposed in the guide pipe, a first end of the connection pipe being connected to the air suction port, and the suction pipe being disposed in the connection pipe and connected to a second end of the connection pipe, the connection pipe is a copper pipe; and each of the suction pipe and the guide pipe is a steel pipe.

Beneficial Effects

The compressor according to the present disclosure includes the compressor body, the reservoir, and a connection pipe. The compressor body includes the housing and the compression assembly disposed in the housing. The compression cavity is defined by the compression assembly and has the air suction port, and the guide pipe is disposed at the housing. The reservoir includes the suction pipe. The connection pipe is disposed in the guide pipe. The first end of the connection pipe is connected to the air suction port, and the suction pipe is disposed in the connection pipe and connected to the second end of the connection pipe. The connection pipe is a copper pipe; and each of the suction pipe and the guide pipe is the steel pipe. In this way, the cost can be reduced due to decreased use of the copper pipe. Meanwhile, the welding efficiency can be improved, and a welding quality of a product is ensured.

BRIEF DESCRIPTION OF THE DRAWINGS

In order to clearly explain technical solutions of embodiments of the present disclosure or technical solutions in the related art, drawings used in description of the embodiments or the related art will be briefly described below. The drawings described below merely illustrate some embodiments of the present disclosure. Based on these drawings, other drawings can be obtained by those skilled in the art without creative effort.

Figure 1:
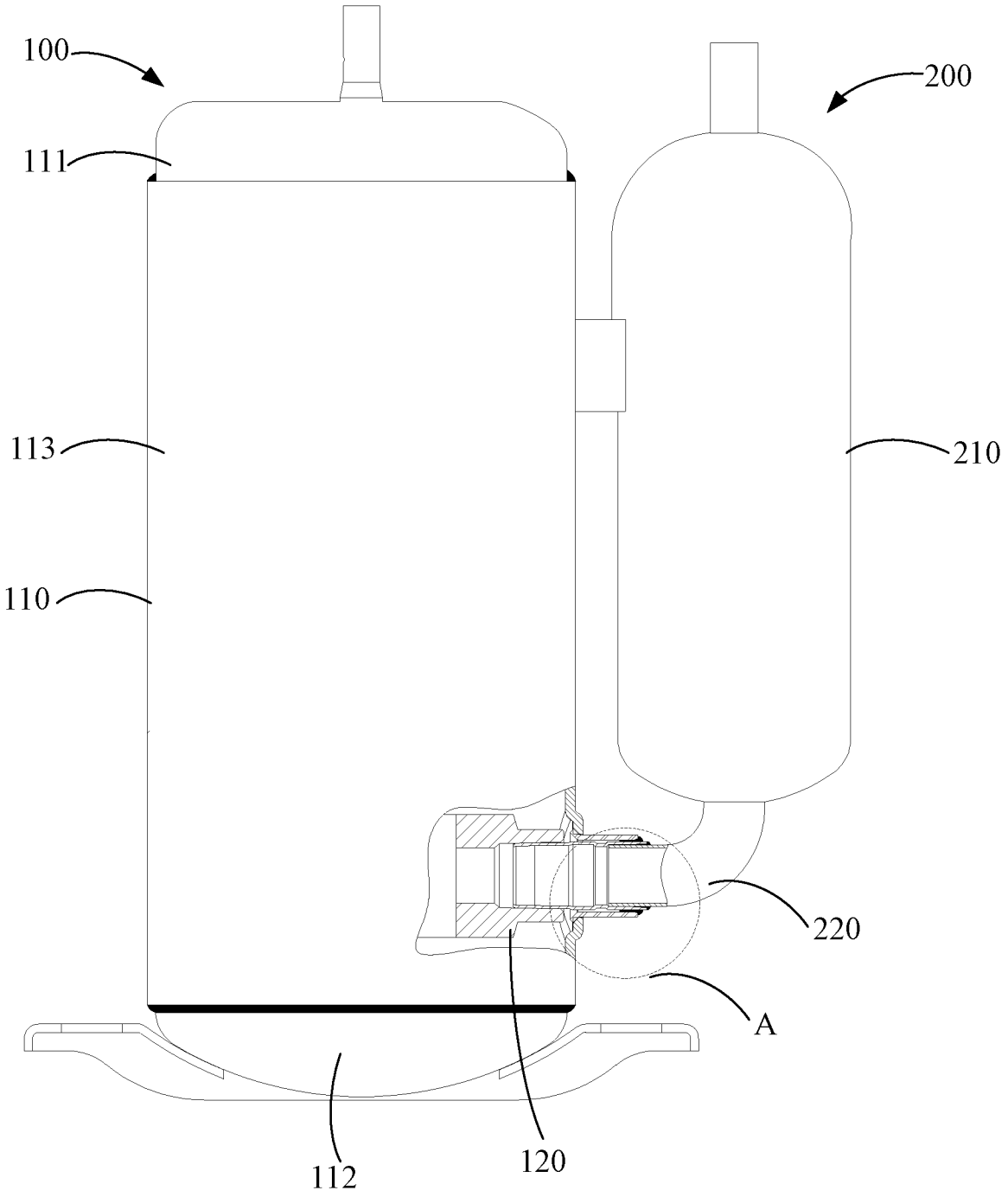
FIG. 1 is a schematic structural diagram of a compressor according to an embodiment of the present disclosure.

Reference numerals shown in the figures are descried in the following table.

| Number | Name |
|---|---|
| 100 | Compressor body |
| 110 | Housing |
| 111 | Upper housing |
| 112 | Lower housing |
| 113 | Outer housing |
| 120 | Compression assembly |
| 130 | Guide pipe |
| 200 | Reservoir |
| 210 | Casing |
| 220 | Suction pipe |
| 300 | Connection pipe |
| 301 | First welding gap |
| 302 | Second welding gap |
| 310 | Flare section |
| 320 | Position limit section |
| 321 | Stepped surface |
| 330 | Neck section |
| 331 | Stop surface |
| 340 | Connection section |

Implementation, functional characteristics, and advantages of the present disclosure will be further described with reference to the accompanying drawings.

DETAILED DESCRIPTION

It should be noted that, if embodiments of the present disclosure relate to descriptions such as "first" and "second", the "first" or "second" is only for descriptive purposes, rather than indicating or implying relative importance or implicitly indicating the number of indicated technical features. Therefore, the features defined with "first" or "second" can explicitly or implicitly include at least one of the features. In addition, the meaning of "and/or" as it appears throughout the present disclosure is that three concurrent solutions are included. For example, "A and/or B" includes a solution A, or a solution B, or solutions where both A and B are satisfied.

The present disclosure provides a compressor.

In embodiments of the present disclosure, as illustrated in FIG. 1, the compressor includes a compressor body 100, a reservoir 200, and a connection pipe 300. The compressor body 100 includes a housing 110 and a compression assembly 120 disposed in the housing 110. A compression cavity is defined by the compression assembly 120 and has an air suction port, and a guide pipe 130 is formed in the housing 110. The reservoir 200 includes a suction pipe 220. The connection pipe 300 is disposed in the guide pipe 130. A first end of the connection pipe 300 is connected to the air suction port, and the suction pipe 220 is disposed in the connection pipe 300 and is connected to a second end of the connection pipe 300. The connection pipe 300 is a copper pipe, and each of the suction pipe 220 and the guide pipe 130 is a steel pipe.

In one embodiment, the compressor body 100 includes the housing 110, the compression assembly 120, and a motor assembly. An accommodation cavity is formed in the housing 110, and the compression assembly 120 and the motor assembly are disposed in the accommodation cavity. The housing 110 is a sealed container and may include an upper housing 111, a lower housing 112, and an outer housing 113. The outer housing 113 is of a run-through bucket shape from top to bottom, and the upper housing 111 and the lower housing 112 are disposed at an upper end and a lower end of the outer housing 113, respectively. The compression assembly 120 includes a crankshaft, an air cylinder, a piston, a main bearing, an auxiliary bearing, a slidable sheet, etc., and one or more air cylinders may be provided, which is not specifically limited herein. The main bearing and the auxiliary bearing are disposed at an upper end and a lower end of the air cylinder, respectively. When a plurality of air cylinders is provided and are sequentially arranged up and down, the main bearing is disposed at an upper end of an air cylinder at an uppermost end, and the auxiliary bearing is disposed at a lower end of an air cylinder at a lowermost end. The compression cavity is defined by the compression assembly 120. The air cylinder has air suction port in communication with the compression cavity, and the main bearing and/or the auxiliary bearing has an air discharge port in communication with the compression cavity. The crankshaft is engaged with each of the main bearing and the auxiliary bearing and is rotatably disposed in the housing 110. The piston is eccentrically and rotatably disposed in the air cylinder, the crankshaft is connected to the piston to drive the piston to eccentrically rotate, and the crankshaft drives the piston to rotate and compress a refrigerant in the air cylinder. A spring is compressed at a back side of the slidable sheet to enable a front side of the slidable sheet to be connected to an outer circumference of the piston, and an interior of the air cylinder is divided into a high-pressure cavity and a low-pressure cavity through the slidable sheet. Since the refrigerant is compressed through the rotation of the piston, a pressure in the high-pressure cavity is increased. When the pressure in the high-pressure cavity rises to be slightly greater than an external pressure of the compression assembly 120, a high-pressure gas refrigerant can be discharged through the air discharge port. The motor assembly includes a stator and a rotor. The stator is fixed on the housing 110, the rotor can rotate relative to the stator, and an upper end of the crankshaft extends out from the main bearing and then is fixedly connected to the rotor to rotate synchronously with the rotor. After the motor assembly is started, a magnetic field is generated, the magnetic field generates an electromagnetic force on the rotor to drive the rotor to rotate, and the crankshaft can be driven to rotate after the rotor rotates. During the rotation of the crankshaft, the piston is driven by the crankshaft to rotate eccentrically, hence a position of a hollow cavity between the piston and the air cylinder also changes. In this way, a gaseous refrigerant is compressed to form the high-pressure gas.

The reservoir 200 includes a casing 210 and the suction pipe 220. An end of the suction pipe 220 extends into the casing 210, and another end of the suction pipe 220 extends out of a bottom end of the casing 210 and is connected to the air suction port of the compression assembly 120 via the connection pipe 300. Thus, the gaseous refrigerant in the casing 210 is transmitted into the compression cavity of the compression assembly 120. In one embodiment, the connection pipe 300 is disposed in the guide pipe 130, a first end of the connection pipe 300 is connected to the air suction port, and the suction pipe 220 is disposed in the connection pipe 300 and is connected to a second end of the connection pipe 300. The connection pipe 300 is a copper pipe. The connection pipe is softer due to a copper material, which is conducive to preventing the air suction port of the compression assembly 120 from deforming. Each of the suction pipe 220 and the guide pipe 130 is a steel pipe. On the one hand, use of the copper pipe is reduced, and the cost is reduced. On the other hand, the connection pipe 300 and the suction pipe 220 can be welded and fixed through an operation of high-frequency induction brazing, and likewise the connection pipe 300 and the guide pipe 130. The operation of high-frequency induction brazing is to place a welding ring (such as a copper-zinc welding ring, but not limited thereto) in a welding gap and then perform welding. Due to use of a solder of the welding ring, the welding ring itself has a weight and can be well attached to the welding gap, and the solder at each position of the welding gap can be uniformly distributed. In this way, the welding efficiency can be improved, and the welding quality is ensured. In the related art, since each of the connection pipe 300, the suction pipe 220, and the guide pipe 130 is the copper pipe, the copper pipe is generally welded through an operation of flame brazing. When the operation of the flame brazing is performed, uniform distribution of the solder in the welding gap is necessarily a guarantee of the welding quality due to use of strip-shaped solder. As a result, the welding is often inefficient.

The compressor according to the present disclosure includes the compressor body 100, the reservoir 200, and a connection pipe 300. The compressor body 100 includes the housing 110 and the compression assembly 120 disposed in the housing 110. The compression cavity is defined by the compression assembly 120 and has the air suction port, and the guide pipe 130 is disposed at the housing 110. The reservoir 200 includes the suction pipe 220. The connection pipe 300 is disposed in the guide pipe 130. The first end of the connection pipe 300 is connected to the air suction port, and the suction pipe 220 is disposed in the connection pipe 300 and connected to the second end of the connection pipe 300. The connection pipe 300 is a copper pipe; and each of the suction pipe 220 and the guide pipe 130 is the steel pipe. In this way, the cost can be reduced due to decreased use of the copper pipe. Meanwhile, the welding efficiency can be improved, and the welding quality of a product is ensured.

Figure 2:
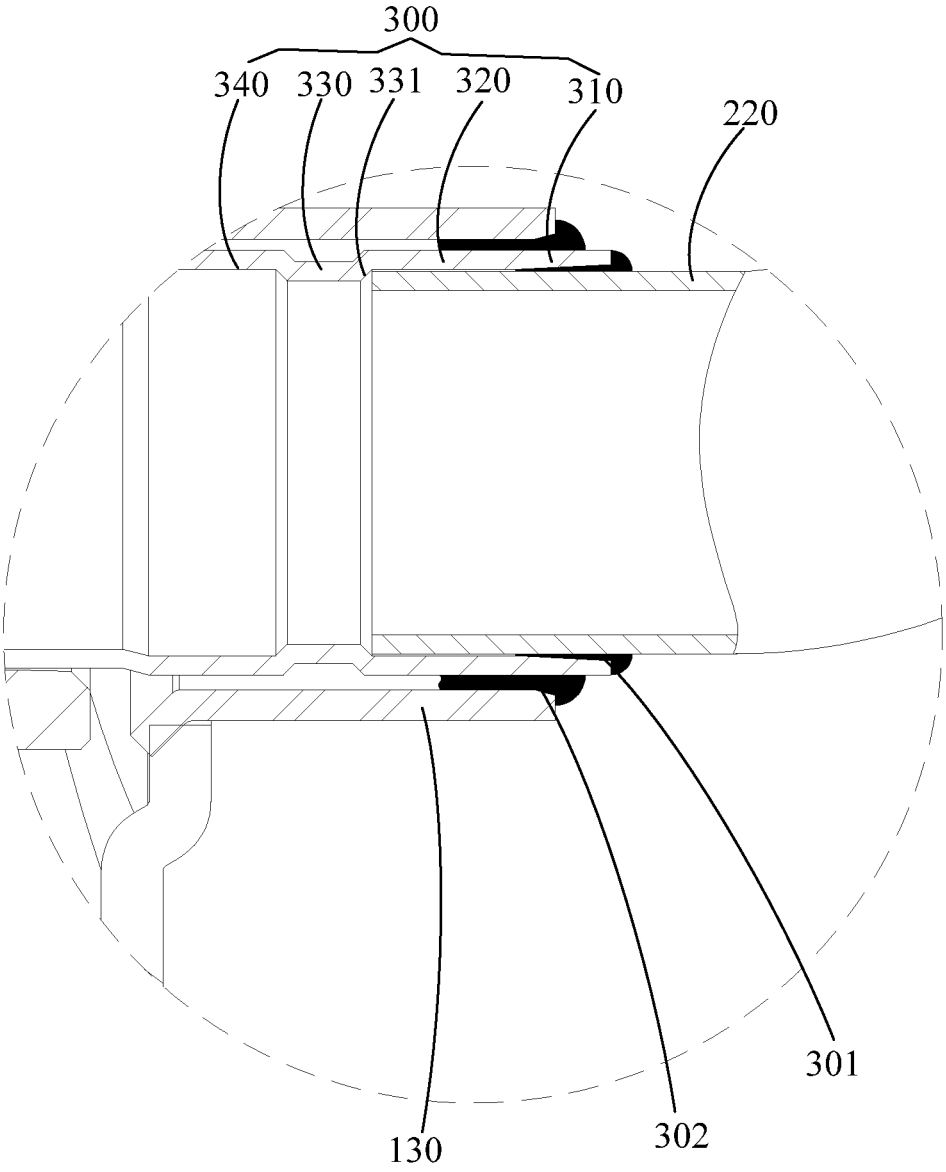
FIG. 2 is a partial enlarged view at a position A in FIG. 1.

With reference to FIG. 2, in one embodiment, an inner surface of the connection pipe 300 is spaced apart from an outer surface of the suction pipe 220 to form a first welding gap 301, and an outer surface of the connection pipe 300 is spaced apart from an inner surface of the guide pipe 130 to form a second welding gap 302. A width of the first welding gap 301 is smaller than a width of the second welding gap 302.

In this embodiment, the width of the first welding gap 301 is smaller than the width of the second welding gap 302. On the one hand, an excessive inclination of the suction pipe 220 of the reservoir 200 can be limited in the connection pipe 300, thereby avoiding an excessively small width of the first welding gap 301 caused by the suction pipe 220 of the reservoir 200 completely attaching to an inner wall face of the connection pipe 300 in the connection pipe 300. Thus, the welding quality is guaranteed. On the other hand, the solder in the first welding gap 301 can also be prevented from flowing into an interior of the connection pipe 300 along the first welding gap 301.

In one embodiment, the width of the first welding gap 301 is smaller than or equal to 0.3 mm; and/or the width of the second welding gap 302 is greater than or equal to 0.3 mm.

By setting the width of the first welding gap 301 to be smaller than or equal to 0.3 mm, the excessive inclination or excessive displacement of the suction pipe 220 of the reservoir 200 located inside the connection pipe 300 can be effectively avoided, and an enough welding gap between the suction pipe 220 of the reservoir 200 and the connection pipe 300 can be ensured consistently. In this way, the welding quality can be further guaranteed. Meanwhile, the smaller welding gap can increase resistance when the solder flows into the connection pipe 300 from the first welding gap, and thus the solder is prevented from flowing into the connection pipe 300 through the first welding gap 301 and thus the product quality is not affected. The width of the second welding gap 302 is greater than or equal to 0.3 mm, and thus it can be ensured that solder can fully flow in the second welding gap 302 during welding. In this way, sufficient filling of the solder is guaranteed to avoid stability of the welding is affected due to insufficient solder filling.

Further, the width of the first welding gap 301 is greater than or equal to 0.05 mm. The width of the first welding gap 301 may be 0.05 mm, 0.1 mm, 0.15 mm, 0.2 mm, 0.25 mm, 0.3 mm, etc. Welding fastness between the connection pipe 300 and the suction pipe 220 of the reservoir 200 is reduced in the case that the width of the first welding gap 301 is too large. The width of the second welding gap 302 is smaller than or equal to 0.8 mm. The width of the second welding gap 302 may be 0.4 mm, 0.45 mm, 0.5 mm, 0.55 mm, 0.6 mm, 0.7 mm, 0.8 mm, etc. The solder is wasted in the case that the width of the second welding gap 302 is too large.

In the embodiments of the present disclosure, the second end of the connection pipe 300 may have a plurality of structures. For example, the second end of the connection pipe 300 may be a straight pipe or a substantially straight pipe. The second end of the connection pipe 300 may also be a conical pipe. As illustrated in FIG. 2, in one embodiment, the connection pipe 300 includes a position limit section 320 and a flare section 310 extending from the position limit section 320 and in a direction facing away from the compressor body. The first welding gap 301 includes a first sub-gap and a second sub-gap. The first sub-gap is formed between an inner surface of the position limit section 320 and the outer surface of the suction pipe 220. The second sub-gap is formed between an inner surface of the flare section 310 and the outer surface of the suction pipe 220. A width of the first sub-gap is smaller than or equal to a width of the second sub-gap.

By setting the width of the first sub-gap to be smaller than the width of the second sub-gap, the position limit section 320 can limit a position of the suction pipe 220 of the reservoir 200 to limit the excessive inclination of the suction pipe 220 of the reservoir 200 located inside the position limit section 320. Furthermore, the excessively small width of the first welding gap can be avoided when the suction pipe 220 of the reservoir 200 located inside the connection pipe 300 is completely attached to the inner wall face of the connection pipe 300, and thus the welding quality is guaranteed. In addition, by setting the width of the first sub-gap to be smaller than the width of the second sub-gap, a part of the suction pipe 220 extending into the connection pipe 300 is substantially straight; that is, an inner diameter of the position limit section 320 is smaller than an inner diameter of the flare section 310. In this case, resistance of the solder flowing from the width of the second sub-gap to the width of the first sub-gap is increased to prevent the solder from flowing from the width of the first sub-gap to the inside of the connection pipe 300. It should be explained that the width of the first sub-gap is a radial distance difference between the inner surface of the position limit section 320 and the outer surface of the suction pipe 220, and the width of the second sub-gap is a radial distance difference between the inner surface of the flare section 310 and the outer surface of the suction pipe 220.

The structure of the position limit section 320 and the flare section 310 of the connection pipe 300 will be described in detail as follows.

Figure 3:
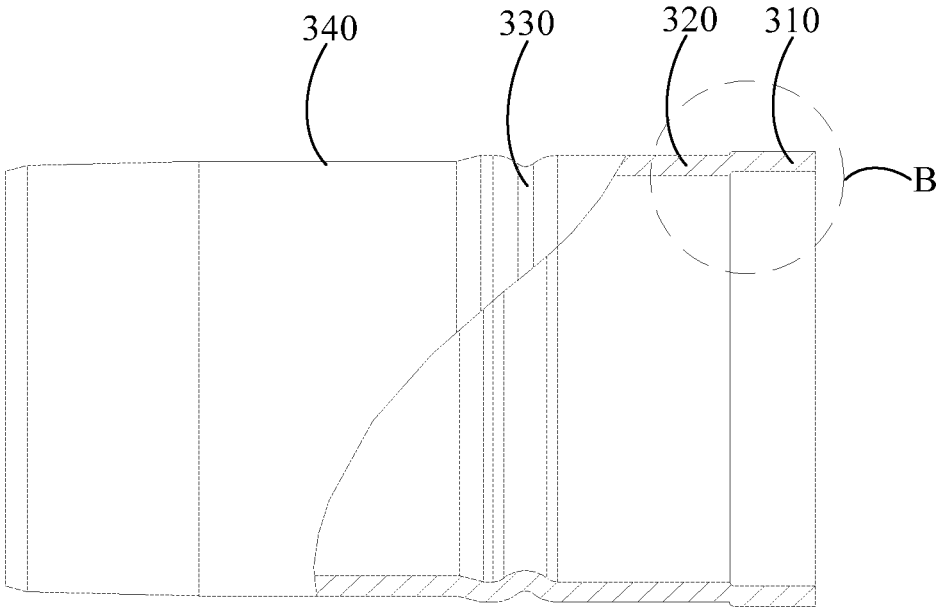
FIG. 3 is a schematic structural diagram of a connection pipe in a compressor according to an embodiment of the present disclosure.
Figure 4:
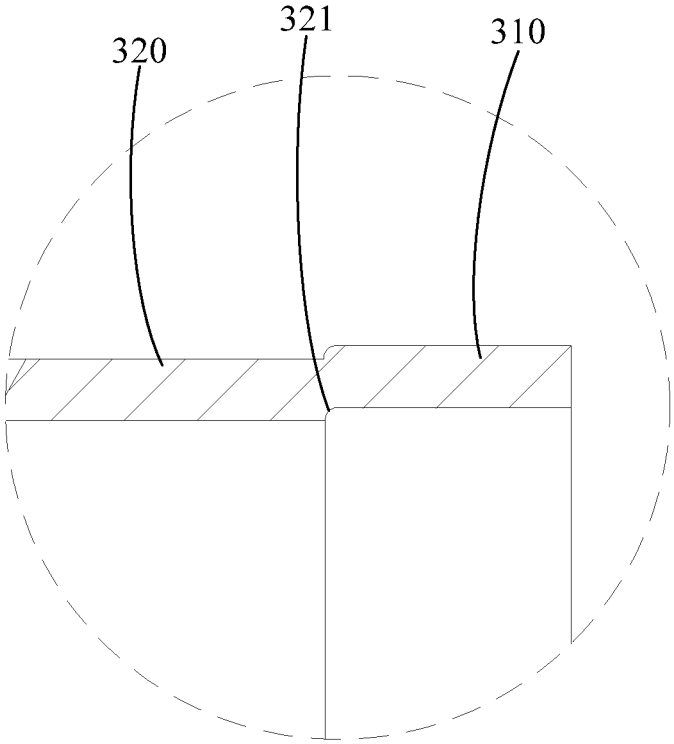
FIG. 4 is a partial enlarged view at a position B in FIG. 3.

With reference to FIG. 3 and FIG. 4, in one embodiment, the inner diameter of the flare section 310 is greater than the inner diameter of the position limit section 320, and the flare section 310 and the position limit section 320 are disposed in a stepped shape. In one embodiment, the flare section 310 and the position limit section 320 are two hollow pipes with different inner diameters. The inner diameter of the flare section 310 is larger than the inner diameter of the position limit section 320, and a stepped surface 321 is formed between the inner surface of the flare section 310 and the inner surface of the position limit section 320. As a result, when the solder flows from the second sub-gap to the first sub-gap, resistance to flow of the solder is increased due to obstruction of the stepped surface 321. Therefore, the solder can be prevented from flowing into the first sub-gap from the second sub-gap, and the solder is prevented from flowing into the connection pipe 300 from the first sub-gap. In addition, the suction pipe 220 of the reservoir 200 is inserted into the position limit section 320, and a larger width of the second sub-gap is formed between the suction pipe 220 of the reservoir 200 and the flare section 310. Thus, an opening of the width of the second sub-gap is large enough to be filled with the solder. Moreover, since the second sub-gap has a sufficient depth, the solder is uniformly distributed in the width of the second sub-gap. In this way, undesirable phenomena, such as, missing of solder and skewness of the welding, can be avoided to ensure the welding quality between the suction pipe 220 of the reservoir 200 and the connection pipe 300.

Figure 5:
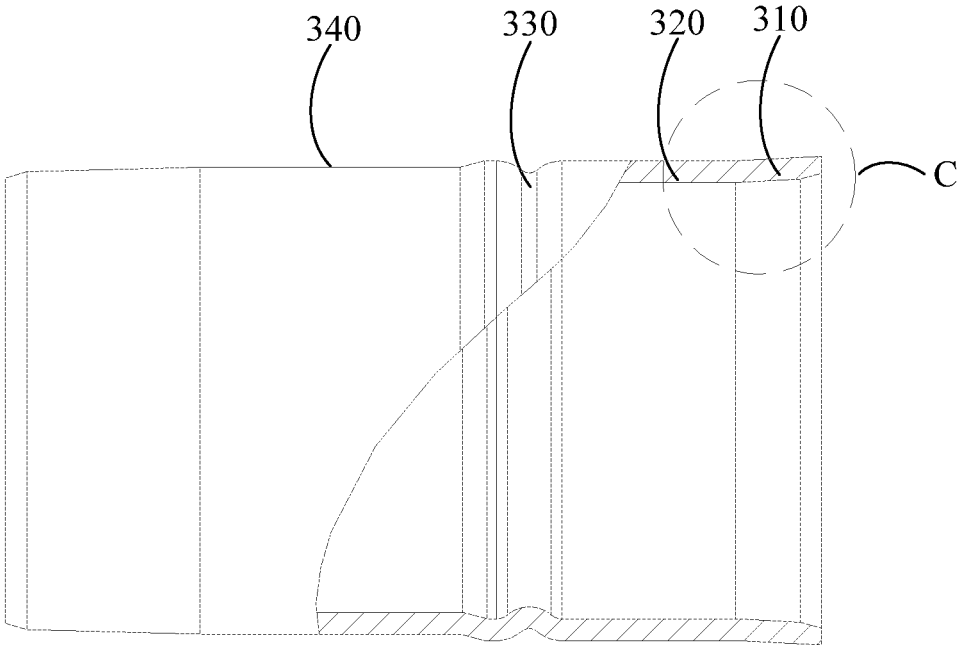
FIG. 5 is another schematic structural diagram of a connection pipe in a compressor according to an embodiment of the present disclosure.
Figure 6:
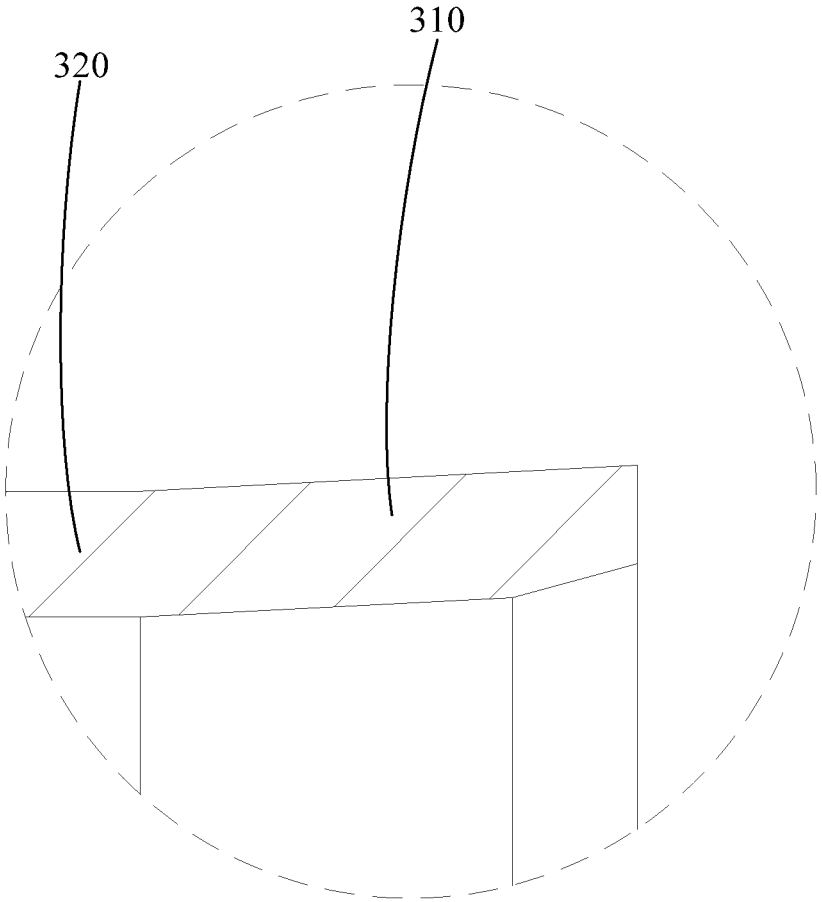
FIG. 6 is a partial enlarged view at a position C in FIG. 5.

With reference to FIG. 5 and FIG. 6, in another embodiment, a cross section of the flare section 310 is gradually flaring in a direction facing away from the position limit section 320. That is, an angle is formed between a side wall of the flare section 310 and an axial line of the flare section 310. In this embodiment, the flare section 310 is in smooth transition connection to the position limit section 320, and the flare section 310 is a pipe structure which is roughly conical in shape. Since the cross section of the flare section 310 is gradually flaring in the direction facing away from the position limit section 320, the second gap formed between the outer surface of the suction pipe 220 of the reservoir 200 and the inner surface of the flare section 310 is gradually flaring in the direction facing away from the position limit section 320. As a result, the opening of the width of the second sub-gap is large enough to facilitate filling of the solder. Moreover, since the flare section 310 has a sufficient depth, the solder can be uniformly distributed in the width of the second sub-gap and has a sufficient fusion depth. In this way, the undesirable phenomena such as the missing of solder and skewness of the welding can be avoided to further ensure the welding quality.

In one embodiment, the angle between the side wall of the flare section 310 and the axial line of the flare section 310 is greater than or equal to 1° and smaller than or equal to 5°.

In this embodiment, since the angle between the side wall of the flare section 310 and the axial line of the flare section 310 is greater than or equal to 1° and smaller than or equal to 5°, it can be ensured that the width of the second sub-gap is greater than the width of the first sub-gap. Thus, the required gap between the suction pipe 220 of the reservoir 200 and the connection pipe 300 during the welding can be guaranteed, and further the reliability of the welding between the suction pipe 220 of the liquid reservoir 200 and the connection pipe 300 can be guaranteed. Furthermore, it is also possible to avoid that the excessively large width of the second sub-gap is overly large due to the excessive inclination of the side wall of the flare section 310, causing waste due to excessive filling of the solder, and even causing the solder to flow out from the width of the second sub-gap to affect the welding quality. The present solution is not limited thereto, and it can be understood that, based on actual requirements of the product, those skilled in the art can adjust the angle between the side wall of the flare section 310 and the axial line of the flare section 310 out of the range from 1° to 5° as appropriate, and this specific aspect thereof will not be articulated herein, but falls in the scope of the present disclosure without departing from the concept of the present disclosure.

Continuing referring to FIG. 2, further, in one embodiment, the connection pipe 300 further includes a neck section 330 connected to an end of the position limit section 320 facing away from the flare section 310. The neck section 330 has an inner diameter smaller than an inner diameter of the position limit section 320 and greater than an inner diameter of the suction pipe 220, and a stop surface 331 is formed between an inner surface of the neck section 330 and the inner surface of the position limit section 320. When the suction pipe 220 of the reservoir 200 is inserted into the connection pipe 300, the stop surface 331 can have a stop and position limit function to limit an insertion depth of the suction pipe 220. Thus, the welding fastness between the suction pipe 220 and the connection pipe 300 can be further ensured. In one embodiment, the stop surface 331 may be a plane perpendicular to the axial line of the connection pipe 300, or may be an inclined surface at a certain inclination angle relative the axial line of the connection pipe 300, which is not specifically limited herein, as long as the stop and position limit function for the suction pipe 220 of the reservoir 200 can be provided.

With reference to FIG. 2, the connection pipe 300 further includes a connection section 340. An end of the connection section 340 is connected to an end of the neck section 330 facing away from the position limit section 320, and another end of the connection section 340 is of a conical shape and in communication with the air suction port. In one embodiment, the connection section 340 is in interference fit with the air suction port. In this embodiment, since the connection pipe 300 is connected to the air suction port through the means of the interference fit, the connection pipe 300 configured as the copper pipe can prevent the air cylinder from deforming when the connection pipe 300 is inserted into the air suction port of the air cylinder.

With reference to FIG. 2, in one embodiment, the end of the guide pipe 130 facing away from the compressor body 100 is flared. In this case, by setting an opening of the guide pipe 130 as a flare opening, an opening of the second welding gap 302 is large enough to facilitate filling of the solder. In this way, it is helpful to ensure the welding fastness between the guide pipe 130 and the connection pipe 300.

In the embodiments of the present disclosure, the casing 210 of the reservoir 200 may have a plurality of structures. For example, the casing 210 includes a body, an upper suction cup, and a lower suction cup, which is not limited thereto. The body forms a run-through bucket shape from top to bottom, and the upper suction cup and the lower suction cup are disposed at an upper end and a lower end of the body, respectively, to form a closed liquid storage cavity with the body.

In one embodiment, the suction pipe 220 includes a first sub-suction pipe and a second sub-suction pipe. The first sub-suction pipe is disposed at a bottom end of the casing 210, the second sub-suction pipe is connected to a first end of the first sub-suction pipe and extends into the casing 210, and a second end of the first sub-suction pipe is connected to the air suction port of the air cylinder via the guide pipe 130. Therefore, the gaseous refrigerant in the casing 210 is transmitted into the compression cavity of the compression assembly 120. Further, the suction pipe 220 further includes a third sub-suction pipe. The third sub-suction pipe is disposed at a top end of the casing 210 and is in communication with the liquid storage cavity, and a free end of the third sub-suction pipe is connected to other pipelines to input the refrigerant into the reservoir 200. In addition, the reservoir 200 further includes a filter disposed in the liquid storage cavity. In one embodiment, the filter is mounted on the upper suction cup, and a pipe orifice at the free end of the second sub-suction pipe is close to the filter. The refrigerant in the liquid storage cavity sequentially passes through the second sub-suction pipe and the first sub-suction pipe and is sucked into the compression cavity of the air cylinder.

The present disclosure further provides a refrigeration apparatus. The refrigeration apparatus includes a compressor, and a specific structure of the compressor may refer to the above-mentioned embodiments. Since the full-segment technical solutions of all the above-mentioned embodiments is applied to the refrigeration apparatus, at least all beneficial effects brought by the technical solutions of the above-mentioned embodiments are not repeated herein. The refrigeration the refrigeration apparatus may include a refrigerator, an air conditioner, a wine cabinet, etc.

The above description is merely alternative embodiments of the present disclosure, and is not therefore intended to limit the patent scope of the present disclosure. Without departing from the principle of the present disclosure, any equivalent structural transformation made by using the specification and accompanying drawings of the present disclosure, or the specification and accompanying drawings of the present disclosure directly/indirectly applied to other related technical fields, are included within the patent protection scope of the present disclosure.

What is claimed is:

1. A compressor comprising:

a compressor body comprising a housing and a compression assembly disposed in the housing, a compression cavity being defined by the compression assembly and having an air suction port, and a guide pipe being disposed at the housing;

a reservoir comprising a suction pipe;

a connection pipe disposed in the guide pipe, a first end of the connection pipe being connected to the air suction port via solder, and the suction pipe being disposed in the connection pipe and connected to a second end of the connection pipe;

a first welding ring placed proximate a first welding gap between the connection pipe and the suction pipe; and a second welding ring placed proximate a second welding gap between the connection pipe and the guide pipe, wherein:

the connection pipe is a copper connection pipe;

the suction pipe is a steel suction pipe and the guide pipe is a steel guide pipe;

the copper connection pipe and the steel suction pipe are bonded by the first welding ring;

the copper connection pipe and the steel guide pipe are bonded by the second welding ring; and the second welding ring comprises copper and zinc.

2. The compressor according to claim 1, wherein:

an inner surface of the connection pipe is spaced apart from an outer surface of the suction pipe to form the first welding gap; and an outer surface of the connection pipe is spaced apart from an inner surface of the guide pipe to form the second welding gap, a width of the first welding gap being smaller than a width of the second welding gap.

3. The compressor according to claim 2, wherein:

the width of the first welding gap ranges between 0.05 mm and 0.25 mm and/or the width of the second welding gap ranges between 0.4 mm and 0.7 mm.

4. The compressor according to claim 2, wherein:

the connection pipe comprises a position limit section and a flare section, the flare section extending from the position limit section in a direction facing away from the compressor body; and the first welding gap comprises a first sub-gap formed between an inner surface of the position limit section and the outer surface of the suction pipe and a second sub-gap formed between an inner surface of the flare section and the outer surface of the suction pipe, a width of the first sub-gap being smaller than or equal to a width of the second sub-gap.

5. The compressor according to claim 4, wherein:

the flare section has an inner diameter greater than an inner diameter of the position limit section; and a stepped surface is formed between the inner surface of the flare section and the inner surface of the position limit section.

6. The compressor according to claim 4, wherein the flare section has a cross section flaring in a direction facing away from the position limit section.

7. The compressor according to claim 4, wherein the connection pipe further comprises a neck section connected to an end of the position limit section facing away from the flare section, the neck section having an inner diameter smaller than an inner diameter of the position limit section and greater than an inner diameter of the suction pipe, and a stop surface being formed between an inner surface of the neck section and the inner surface of the position limit section.

8. The compressor according to claim 7, wherein the connection pipe further comprises a connection section, an end of the connection section being connected to an end of the neck section facing away from the position limit section, and another end of the connection section being of a conical shape and in interference fit with the air suction port.

9. The compressor according to claim 1, wherein:

the connection pipe is fixedly connected to the suction pipe through high-frequency induction brazing; and the connection pipe is fixedly connected to the guide pipe through high-frequency induction brazing.

10. A refrigeration apparatus comprising a compressor, wherein the compressor comprises:

a compressor body comprising a housing and a compression assembly disposed in the housing, a compression cavity being defined by the compression assembly and having an air suction port, and a guide pipe being disposed at the housing;

a reservoir comprising a suction pipe;

a connection pipe disposed in the guide pipe, a first end of the connection pipe being connected to the air suction port via solder, and the suction pipe being disposed in the connection pipe and connected to a second end of the connection pipe;

a first welding ring placed proximate a first welding gap between the connection pipe and the suction pipe; and a second welding ring placed proximate a second welding gap between the connection pipe and the guide pipe, wherein:

the connection pipe is a copper connection pipe;

the suction pipe is a steel suction pipe and the guide pipe is a steel guide pipe;

the copper connection pipe and the steel suction pipe are bonded by the first welding ring;

the copper connection pipe and the steel guide pipe are bonded by the second welding ring; and the second welding ring comprises copper and zinc.

11. The refrigeration apparatus according to claim 10, wherein:

an inner surface of the connection pipe is spaced apart from an outer surface of the suction pipe to form the first welding gap; and an outer surface of the connection pipe is spaced apart from an inner surface of the guide pipe to form the second welding gap, a width of the first welding gap being smaller than a width of the second welding gap.

12. The refrigeration apparatus according to claim 11, wherein:

the width of the first welding gap ranges between 0.05 mm and 0.25 mm; and/or the width of the second welding gap ranges between 0.4 mm and 0.7 mm.

13. The refrigeration apparatus according to claim 11, wherein:

the connection pipe comprises a position limit section and a flare section, the flare section extending from the position limit section in a direction facing away from the compressor body; and the first welding gap comprises a first sub-gap formed between an inner surface of the position limit section and the outer surface of the suction pipe and a second sub-gap formed between an inner surface of the flare section and the outer surface of the suction pipe, a width of the first sub-gap being smaller than or equal to a width of the second sub-gap.

14. The refrigeration apparatus according to claim 13, wherein:

the flare section has an inner diameter greater than an inner diameter of the position limit section; and a stepped surface is formed between the inner surface of the flare section and the inner surface of the position limit section.

15. The refrigeration apparatus according to claim 13, wherein the flare section has a cross section flaring in a direction facing away from the position limit section.

16. The refrigeration apparatus according to claim 13, wherein the connection pipe further comprises a neck section connected to an end of the position limit section facing away from the flare section, the neck section having an inner diameter smaller than an inner diameter of the position limit section and greater than an inner diameter of the suction pipe, and a stop surface being formed between an inner surface of the neck section and the inner surface of the position limit section.

17. The refrigeration apparatus according to claim 16, wherein the connection pipe further comprises a connection section, an end of the connection section being connected to an end of the neck section facing away from the position limit section, and another end of the connection section being of a conical shape and in interference fit with the air suction port.

18. A method of assembling a compressor, the method comprising:

placing a copper connection pipe within a steel guide pipe disposed at a housing of the compressor;

placing a steel suction pipe of a reservoir within the copper connection pipe;

placing a first welding ring formed of solder proximate a first welding gap between the copper connection pipe and the steel suction pipe; and placing a second welding ring formed of solder proximate a second welding gap between the copper connection pipe and the steel guide pipe;

and performing high-frequency induction brazing to:

melt the first welding ring to cause the solder of the first welding ring to flow into the first welding gap to bond the copper connection pipe and the steel suction pipe; and melt the second welding ring to cause the solder of the second welding ring to flow into the second welding gap to bond the copper connection pipe and the steel guide pipe, wherein the second welding ring comprises copper and zinc.

19. The method according to claim 18, wherein the copper connection pipe is placed within the steel guide pipe with the first welding gap ranging between 0.05 mm and 0.25 mm.

20. The method according to claim 18, wherein the steel suction pipe is placed within the copper connection pipe with the second welding gap ranging between 0.4 mm and 0.7 mm.

* * * * *